United States Patent [19]

Kawazoe et al.

[11] Patent Number: 4,947,543

[45] Date of Patent: Aug. 14, 1990

[54] METHOD OF WINDING WIRE ON INNER SURFACE OF CYLINDRICAL MEMBER

[75] Inventors: Hiroshi Kawazoe, Hirakata; Tokuhito Hamane, Nara, both of Japan

[73] Assignee: Matsushita Electric Industrial Co., Ltd., Osaka, Japan

[21] Appl. No.: 416,323

[22] Filed: Oct. 2, 1989

[51] Int. Cl.[5] ..... H01F 41/06

[52] U.S. Cl. ..... 29/605; 140/92.2

[58] Field of Search ..... 29/596, 605, 606, 736; 140/92.2

[56] References Cited

U.S. PATENT DOCUMENTS 4,448,054 5/1984 Wayne ..... 29/605 X 4,724,604 2/1988 Kawazoe et al. ..... 29/606

*Primary Examiner*—Carl E. Hall

*Attorney, Agent, or Firm*—Wenderoth, Lind & Ponack

[57] ABSTRACT

A method of forming a coiled wire in an annular groove formed on an inner surface of a cylindrical member, comprising the steps of: holding one end portion of a wire discharged from a distal end of a feed nozzle; rotating the feed nozzle about one of a pair of connecting pins provided at one end of the cylindrical member so as to wrap the wire around the one connecting pin; retaining the wire by a hook pin in the vicinity of a point of intersection between the annular groove and an axial groove which extends from the one end of the cylindrical member so as to intersect with the annular groove; rotating the feed nozzle along the annular groove and pressing the wire against a bottom face of the annular groove by a roller at a position disposed downstream in a rotational direction of the feed nozzle so as to not only feed the wire to the annular groove but wind the wire in the annular groove through a predetermined number of turns; and wrapping the wire around the other connecting pin in a state where the wire is retained at the point of intersection by the roller.

2 Claims, 7 Drawing Sheets

METHOD OF WINDING WIRE ON INNER SURFACE OF CYLINDRICAL MEMBER

BACKGROUND OF THE INVENTION

The present invention relates to a method of forming a coiled wire in an annular groove formed on an inner surface of a cylindrical member.

Conventionally, in order to form a coiled wire in an annular groove formed on an inner surface of a cylindrical core, a forming method is employed as shown in FIG. 1. In the known forming method, a wire is preliminarily wound outside a core 22 and formed into a coil 21 by self-fusion, etc. The coil 21 is inserted into the core 22 by deforming the coil 21 so as to reduce diameter of the coil 21. Then, the coil 21 is again formed in an annular groove 23 of the core 22.

However, the known forming method undesirably needs many steps such as winding, forming, deforming, inserting and re-forming steps. Furthermore, the known forming method has such a drawback that it is difficult to deform the coil so as to properly set the coil in the annular groove, thereby frequently resulting in improper deformation of the coil.

Meanwhile, in Japanese Pat. Laid-Open Publication No. 100911/1986, the assignee assigned by the present inventors proposed a method in which bonding agent is applied to a bottom face of an annular groove and a wire is drawn from a feed nozzle so as to be delivered to the annular groove and wound in the annular groove such that the wire is bonded to the bottom face of the annular groove by a pressing roller disposed downstream in a rotational direction of the feed nozzle.

Thus, in this prior art method in which the wire is fixed to the annular groove by bonding agent while being wound, such advantages can be achieved that since the wire is directly wound in the annular groove, the number of necessary steps can be lessened and the wire can be positively set in the annular groove. However, in this prior art method, if bonding agent has adhered to the pressing roller, the pressing roller may detach the wound wire from the annular groove on the contrary. Furthermore, the prior art method has such a disadvantage that processing of end portions of the coiled wire is required to be separately performed after curing of bonding agent, which is troublesome.

SUMMARY OF THE INVENTION

Accordingly, an essential object of the present invention is, with a view to eliminating the disadvantages inherent in the conventional winding methods, to provide a method of forming a coiled wire in an annular groove formed on an inner surface of a cylindrical member, in which the coiled wire can be directly formed in the annular groove without the need of use of bonding agent and the number of a series of steps up to processing of end portions of the coiled wire can be reduced.

In order to accomplish this object of the present invention, a method of forming a coiled wire in an annular groove formed on an inner surface of a cylindrical member, according to the present invention comprises the steps of: holding one end portion of a wire discharged from a distal end of a feed nozzle; rotating the feed nozzle about one of a pair of connecting pins provided at one end of the cylindrical member so as to wrap the wire around the one of the connecting pins; retaining the wire by a hook pin in the vicinity of a point of intersection between the annular groove and an axial groove which extends from the one end of the cylindrical member so as to intersect with the annular groove; rotating the feed nozzle along the annular groove and pressing the wire against a bottom face of the annular groove by a roller at a position disposed downstream in a rotational direction of the feed nozzle so as to not only feed the wire to the annular groove but wind the wire in the annular groove through a predetermined number of turns; and wrapping the wire around the other one of the connecting pins in a state where the wire is retained at the point of intersection by the roller.

In accordance with the present invention, since the coiled wire can be formed in the annular groove directly and properly without bonding agent and the opposite end portions of the wire can be wrapped around a pair of the connecting pins, respectively, processing up to disposal of the opposite end portions of the wire can be completed by a series of a small number of the steps.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
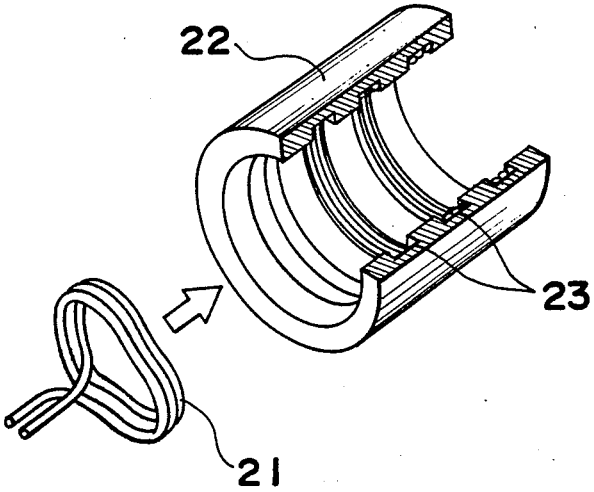
Fig. 1 PRIOR ART
FIG. 1 is a view explanatory of a prior art winding method (already referred to)
Figure 2:
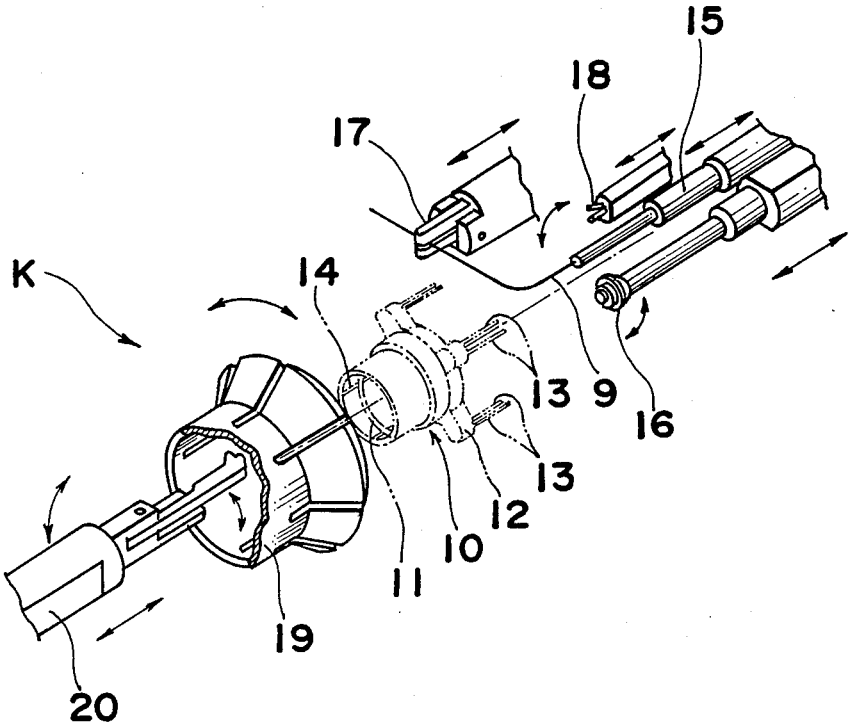
FIG. 2 is a fragmentary perspective view of a winding apparatus employed for working a winding method according to one embodiment of the present invention.
Figure 3:
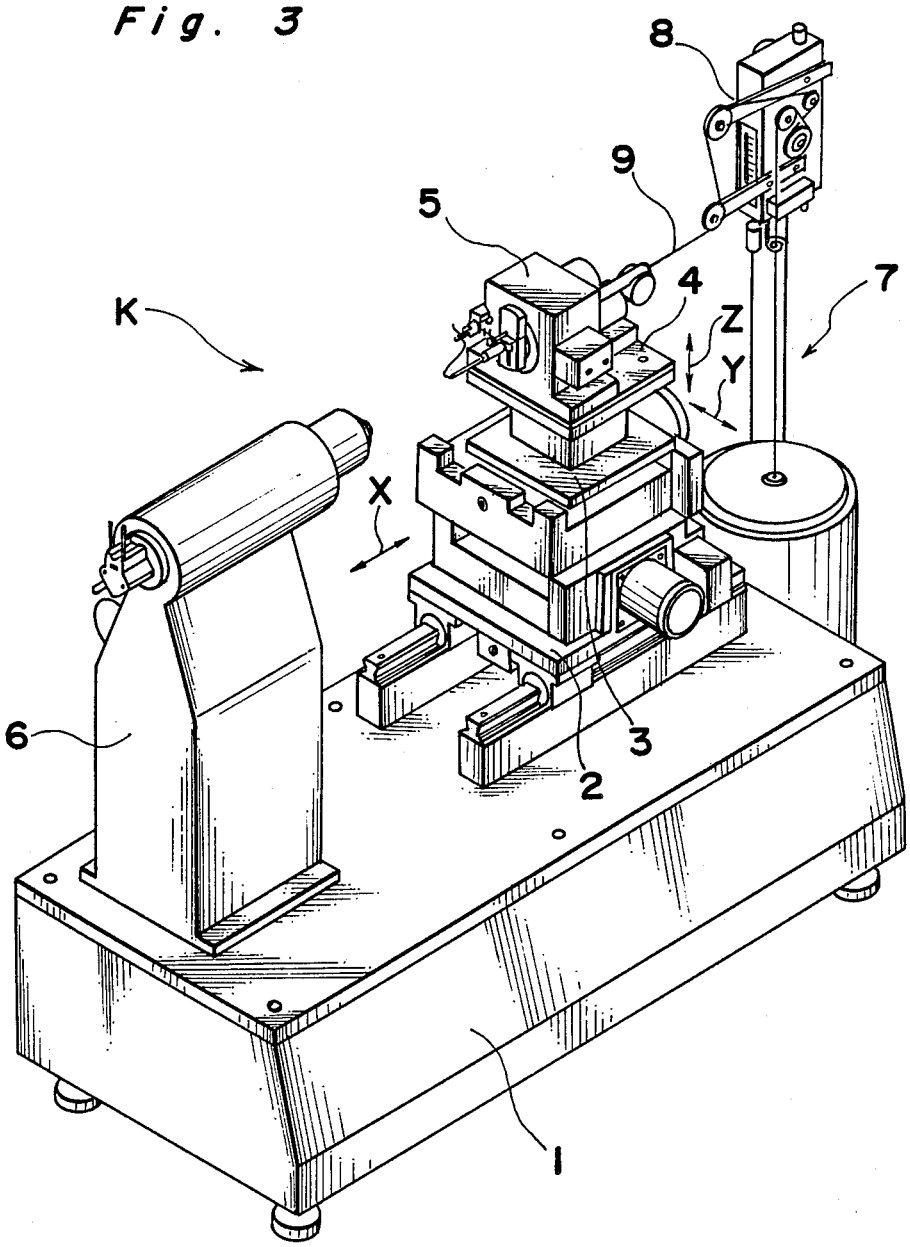
FIG. 3 is a whole perspective view of the winding apparatus of FIG. 2.

Referring now to the drawings, there is shown in FIGS. 2 to 12, a winding apparatus K for working a winding method according to one embodiment of the present invention. In FIGS. 2 and 3, the winding apparatus K includes a base 1, an X table 2 movable in the direction of the arrow X, a Y table 3 movable in the direction of the arrow Y perpendicular to the direction of the arrow X and a Z table 4 movable in the vertical direction of the arrow Z. The X table 2 is provided at one end portion of an upper face of the base 1 and the Y table 3 is placed on the X table 2, while the Z table 4 is placed on the Y table 3. A winding head 5 is provided on the Z table 4. A chucking stand 6 for gripping a work 10 to be subjected to formation of a coiled wire is disposed at the other end portion of the upper face of the base 1. The winding apparatus K further includes a wire feeding portion 7 for feeding a wire 9 to the winding head 5 and a tension device 8 for straining the wire 9.

Figure 4:
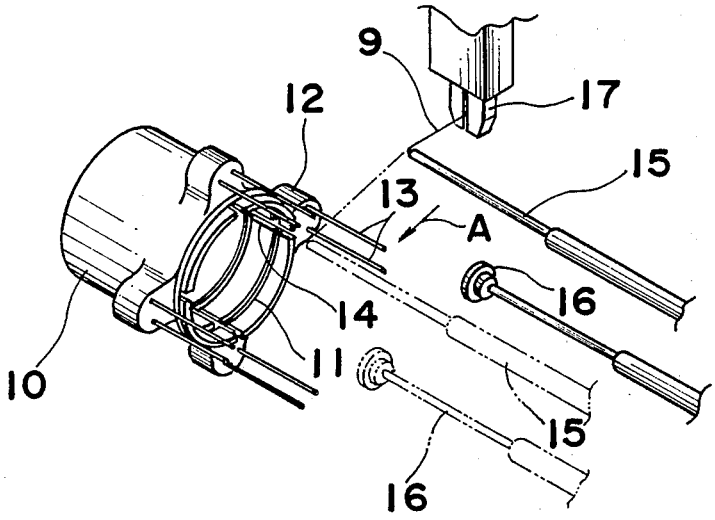
FIGS. 4 to 10 are views indicative of steps of the winding method of FIG. 2, respectively.

As shown in FIG. 4, the work 10 is constituted by a cylindrical member. A plurality of annular grooves 11 are formed on an inner surface of the work 10 and a pair of connecting pins 13 are extended from each of a plurality of projections 12 extruding radially outwardly at one end portion of the work 10 and corresponding, in number, to the annular grooves 11. Furthermore, at positions corresponding to those of the projections 12, a plurality of axial grooves 14 having a depth larger than that of the annular grooves 11 are, respectively, formed on the inner surface of the work 10 so as to intersect with the annular grooves 11.

The winding head 5 includes a feed nozzle 15 for discharging the wire 9 from the wire feeding portion 7, a pressing roller 16 for pressing the wire 9 against bottom faces of the annular grooves 11 of the work 10, a holder 17 for holding an end portion of the wire 9 and a cutter 18 for cutting the wire 9. The chucking stand 6 includes a chucking member 19 for gripping the work 10 and a hook pin 20 for retaining the wire 9 in the axial grooves 14.

Figure 5:
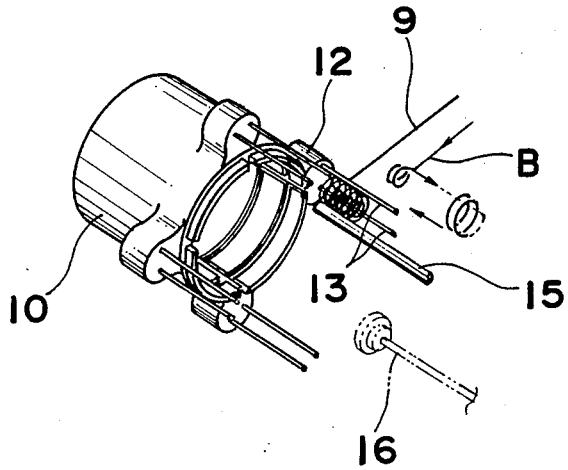
Figure 6:
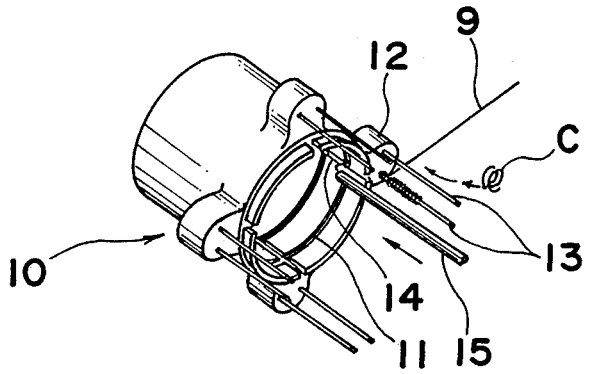
Figure 7:
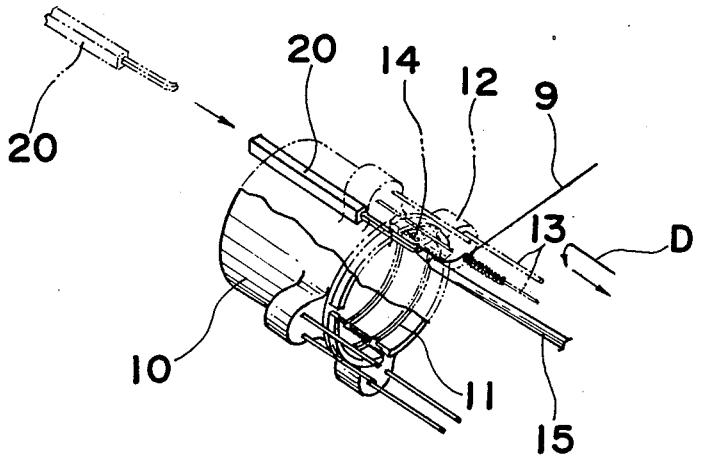
Figure 8:
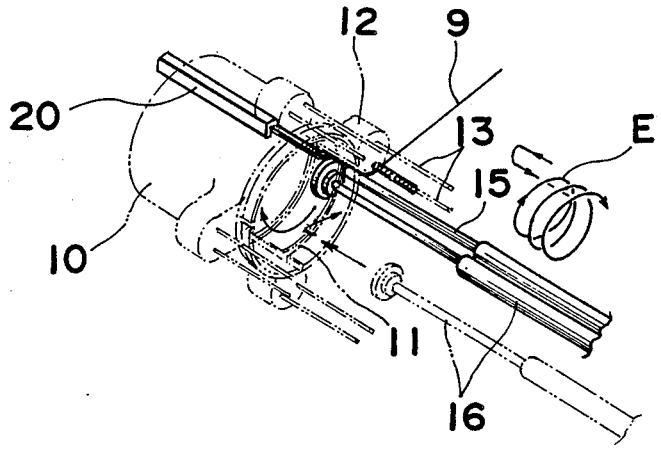
Figure 9:
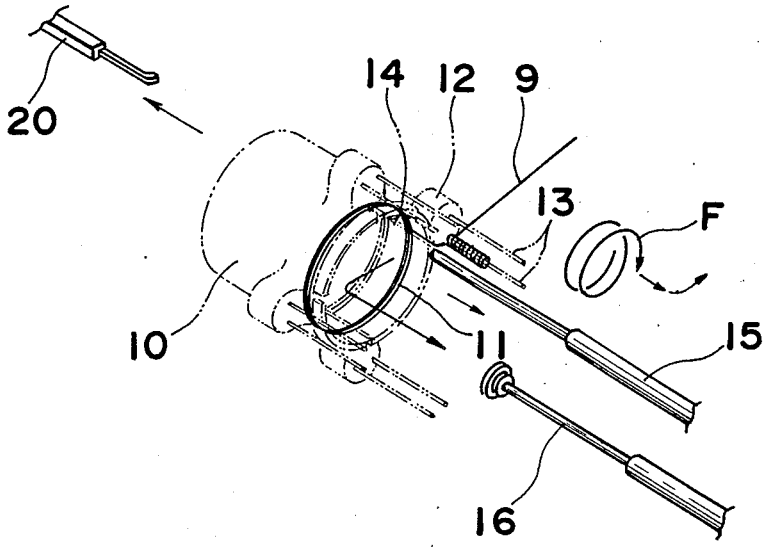
Figure 10:
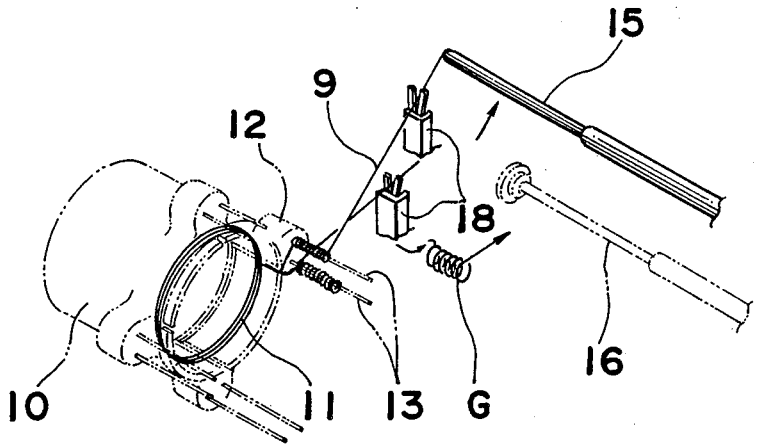
Figure 11:
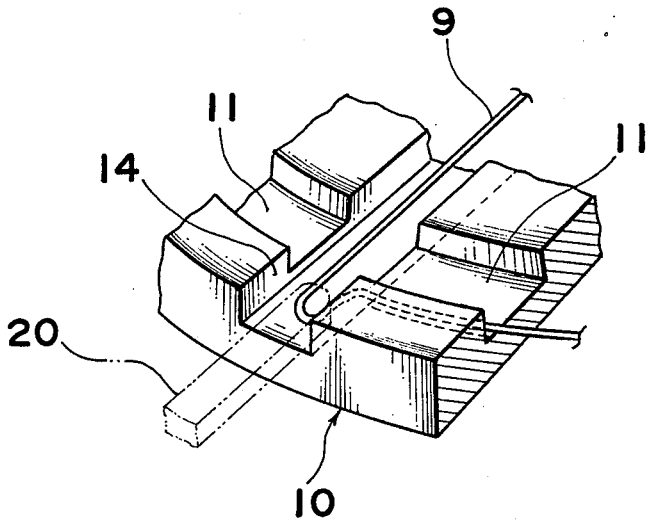
FIGS. 11 and 12 are enlarged fragmentary perspective views indicative of the steps of FIGS. 7 and 8, respectively.
Figure 12:
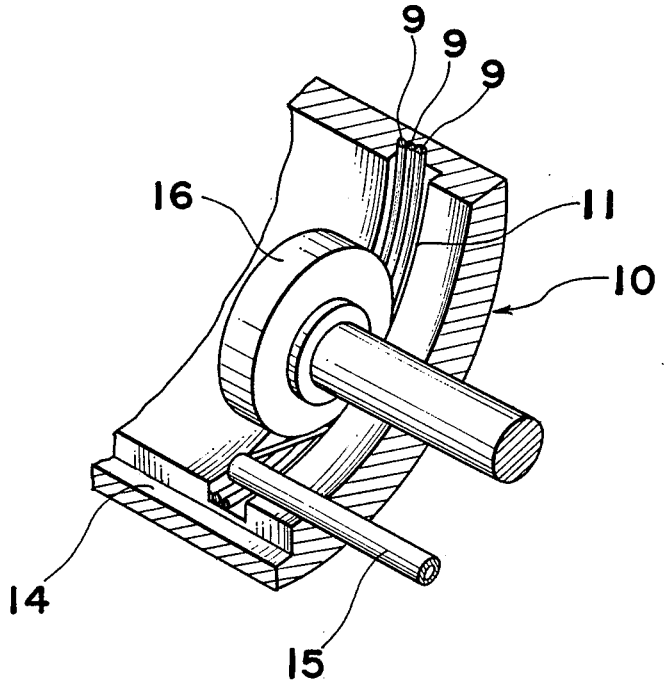

Hereinbelow, steps of the winding method of the present invention are described with reference to FIGS. 4 to 12. As shown in FIG. 4, a distal end portion of the wire 9 discharged from an end of the feed nozzle 15 is initially gripped by the holder 17. Then, the feed nozzle 15 is displaced to a pair of the connecting pins 13 in the direction of the arrow A. Subsequently, as shown in FIG. 5, the wire 9 is rotated about one of the connecting pins 13 as shown in the direction of the arrow B so as to be wrapped therearound. Then, as shown in FIG. 6, the feed nozzle 15 is inserted into the work 10 along the corresponding one of the axial grooves 14 in the direction of the arrow C such that the distal end portion of the wire 9 is stopped at a position beyond the corresponding annular groove 11 for receiving the coiled wire. Subsequently, as shown in FIGS. 7 and 11, the hook pin 20 is inserted into the work 10 so as to retain the wire 9 in the axial groove 14 at a distal end portion of the feed nozzle 15. The feed nozzle 15 is retracted in the direction of the arrow D such that the distal end of the feed nozzle 15 is flush with one side face of the annular groove 11. Then, as shown in FIGS. 8 and 12, not only the feed nozzle 15 is rotated along the annular groove 11 in the direction of the arrow E but the wire 9 drawn from the distal end of the feed nozzle 15 upon displacement of the feed nozzle 15 is pressed against the bottom face of the annular groove 11 by the pressing roller 16 such that a coiled wire having a predetermined number of turns is formed in the annular groove 11. Thereafter, as shown in FIG. 9, the feed nozzle 15 is withdrawn out of the work 10 along the axial groove 14 in the direction of the arrow F in a state where the wire 9 is retained at a point of intersection between the annular groove 11 and the axial groove 14 by the pressing roller 16. Subsequently, the hook pin 20 and the pressing roller 16 are also withdrawn out of the work 10. Finally, as shown in FIG. 10, the feed nozzle 15 is rotated about the other connecting pin 13 so as to be wrapped therearound. Surplus portions of the wire 9 extending from a pair of the connecting pins 13 are cut off by the cutter 18 and thus, formation of the coiled wire in the one annular groove 11 as well as processing of the opposite end portions of the wire 9 is completed. Subsequently, the wire 9 is likewise formed in the remaining annular grooves 11 and thus, the wire can be formed in all the annular grooves 11 of the work 10.

As is clear from the foregoing, in accordance with the winding method of the present invention, the wire can be wound in the annular grooves directly and properly without using bonding agent. Furthermore, since the opposite end portions of the wire can be, respectively, wrapped around a pair of the connecting pins, processing up to disposal of the end portions of the wire can be completed by a series of a small number of the steps and the high-quality coiled wire can be formed in the annular grooves efficiently.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of forming a coiled wire in an annular groove formed on an inner surface of a cylindrical member, comprising the steps of:

holding one end portion of a wire discharged from a distal end of a feed nozzle;

rotating the feed nozzle about one of a pair of connecting pins provided at one end of the cylindrical member so as to wrap the wire around the one of the connecting pins;

retaining the wire by a hook pin in the vicinity of a point of intersection between the annular groove and an axial groove which extends from the one end of the cylindrical member so as to intersect with the annular groove;

rotating the feed nozzle along the annular groove and pressing the wire against a bottom face of the annular groove by a roller at a position disposed downstream in a rotational direction of the feed nozzle so as to not only feed the wire to the annular groove but wind the wire in the annular groove through a predetermined number of turns; and wrapping the wire around the other one of the connecting pins in a state where the wire is retained at the point of intersection by the roller.

2. A method as claimed in claim 1, further comprising the step of cutting off, by using a cutter, surplus portions of the wire extending from the connecting pins, respectively.

* * * * *